US008163205B2

(12) United States Patent
Zhou et al.

(10) Patent No.: US 8,163,205 B2
(45) Date of Patent: Apr. 24, 2012

(54) DURABLE TRANSPARENT CONDUCTORS ON POLYMERIC SUBSTRATES

(75) Inventors: Chaoyin Zhou, Chino, CA (US); Richard W. Burns, Edwardsville, IL (US)

(73) Assignee: The Boeing Company, Chicago, IL (US)

( * ) Notice: Subject to any disclaimer, the term of this patent is extended or adjusted under 35 U.S.C. 154(b) by 161 days.

(21) Appl. No.: 12/190,025

(22) Filed: Aug. 12, 2008

(65) Prior Publication Data

US 2010/0038601 A1 Feb. 18, 2010

(51) Int. Cl.
*H01B 1/02* (2006.01)
*H01B 1/04* (2006.01)
*H01B 1/22* (2006.01)

(52) U.S. Cl. ..... 252/502; 252/513; 252/514

(58) Field of Classification Search ..... 252/518.1, 252/520.1, 502, 513, 514
See application file for complete search history.

(56) References Cited

U.S. PATENT DOCUMENTS

| | | | | |
|---|---|---|---|---|
| 4,065,600 | A | 12/1977 | King et al. | |
| 4,248,687 | A | 2/1981 | Fan | |
| 4,385,976 | A | 5/1983 | Schuster-Wolden et al. | |
| 5,133,841 | A | 7/1992 | Higo et al. | |
| 5,378,404 | A | 1/1995 | Han et al. | |
| 5,424,055 | A * | 6/1995 | Hayashi et al. | 424/490 |
| 5,626,795 | A | 5/1997 | Smith et al. | |
| 5,968,416 | A | 10/1999 | Smith et al. | |
| 6,533,966 | B1 * | 3/2003 | Nonninger et al. | 252/520.1 |
| 6,554,609 | B2 | 4/2003 | Yadav et al. | |
| 6,576,355 | B2 | 6/2003 | Yadav et al. | |

(Continued)

FOREIGN PATENT DOCUMENTS

| | | | |
|---|---|---|---|
| JP | 2006-059806 | * | 3/2006 |
| WO | WO 2007049573 A1 | * | 5/2007 |
| WO | 2008001998 A1 | | 1/2008 |
| WO | WO 2008026778 A1 | * | 3/2008 |

OTHER PUBLICATIONS

Izumi, H., et al., "Electrical properties of crystalline ITO films prepared at room temperature by pulsed laser deposition on plastic substrates," Thin Solid Films, (2002) vol. 411, pp. 32-35.
Leterrier, Y., et al., "Mechanical integrity of transparent conductive oxide films for flexible polymer-based displays," Thin Solid Films, (2004) vol. 460, pp. 156-166.
Cairns, D.R., et al., "The Mechanical Reliability of Sputter-Coated Indium Tin Oxide Polyester Substrates for Flexible Display and Touchscreen Applications," Mat. Res. Soc. Symp. Proc., (2001) vol. 666, pp. F3.24.1-F3.24.12.
EP Search Report for application No. 09167661.9; Aug. 16, 2011; 5 pages.

(Continued)

*Primary Examiner* — Mark Kopec
*Assistant Examiner* — Jaison Thomas
(74) *Attorney, Agent, or Firm* — Armstrong Teasdale LLP

(57) ABSTRACT

A method of preparing a transparent conductor for application on a polymeric substrate is described. The method includes introducing a functional group onto a surface of the conductor to form a modified conductor, and mixing the modified conductor with a dispersant at slightly elevated temperatures to form a conductive material composition. The dispersant is at least bifunctional. The conductive material composition may then be applied to the polymeric substrate. The dispersant acts as a linker, bonding the transparent conductor and polymeric substrate such that they are fully integrated.

13 Claims, 6 Drawing Sheets

U.S. PATENT DOCUMENTS

| | | | | |
|---|---|---|---|---|
| 6,607,779 | B2 | 8/2003 | Yadav et al. | |
| 6,696,107 | B2 | 2/2004 | Eastham | |
| 7,067,328 | B2 | 6/2006 | Dubrow et al. | |
| 7,153,620 | B2 | 12/2006 | Aylward et al. | |
| 2004/0265550 | A1 | 12/2004 | Glatkowski et al. | |
| 2005/0064647 | A1 | 3/2005 | Manabe et al. | |
| 2006/0029803 | A1* | 2/2006 | Qi et al. | 428/403 |
| 2007/0074316 | A1 | 3/2007 | Alden et al. | |
| 2007/0140937 | A1* | 6/2007 | Cunningham et al. | 423/89 |
| 2007/0176152 | A1 | 8/2007 | Zhong | |
| 2008/0102213 | A1 | 5/2008 | Afzali-Ardakani et al. | |
| 2009/0140284 | A1* | 6/2009 | Kurino et al. | 257/100 |
| 2009/0267033 | A1* | 10/2009 | Zhang | 252/587 |

* cited by examiner

DURABLE TRANSPARENT CONDUCTORS ON POLYMERIC SUBSTRATES

BACKGROUND OF THE INVENTION

The field of the invention relates generally to transparent conductors, and more specifically, to durable transparent conductors on polymeric substrates.

Transparent conducting oxides are commonly referred to as a group of transparent conductors. These transparent conducting oxides are generally defined by one or both of their conductivity and transparency. These conductors have been widely used in a variety of applications including, anti-static coatings, touch screens, flexible displays, electroluminescent devices, electrochromic systems, solar cells, and energy efficient windows, to name a few. The individual applications normally require a certain conductivity and transparency for the materials. Sometimes more stringent requirements may be imposed to ensure the structural and functional integrity of the transparent conducting oxides when the application is deployed in an extreme environment.

Technology associated with the preparation of durable transparent conductors has been key in the development of anti-static coatings, touch screens, flexible displays, and the like. All of these applications are dependent upon excellent performance in the electrical, optical, and mechanical properties of the transparent conductor.

Indium-tin-oxide (ITO) thin films are one of the most common transparent conductors and have been prepared on polymeric substrates such as polyesters or polycarbonates by using sputtering, chemical vapor deposition (CVD), electron beam evaporation, reactive deposition, and pulsed laser deposition. Such approaches usually require high temperature annealing or ultraviolet laser processing, which can damage the polymeric substrates and induce structural and color change, especially if the polymers are aromatics-based systems. In addition, compressive internal stresses can be developed and can easily initiate tensile cracking on ITO thin films.

BRIEF DESCRIPTION OF THE INVENTION

In one aspect, a conductive material composition is provided. The conductive material composition comprises a nanoconductor, wherein a surface of the nanoconductor comprises a first functional group; and a dispersant comprising at least a first functional group and a second functional group.

In another aspect, a method of preparing a transparent nanoconductor for application to a polymeric substrate is provided. The method includes introducing a first functional group onto a surface of the nanoconductor to form a modified nanoconductor; and mixing the modified nanoconductor with a dispersant comprising at least a first functional group and a second functional group to form a conductive material composition, wherein the first functional group on the surface of the modified nanoconductor reacts with the dispersant.

DETAILED DESCRIPTION OF THE INVENTION

The embodiments described herein are related to transparent conductors and more specifically to the composition and processes utilized to prepare transparent conductors on polymeric substrates. Examples of such conductors include transparent conductive oxides such as indium tin oxide (ITO), doped zinc oxide (ZnO), cadmium oxide (CdO), and antimony doped tin oxide (Sb—$SnO_2$). Other conductor examples include graphene sheet, carbon nanotubes, silver, copper, gold, nickel, or their hybrids. Such conductors are modified on the surface (i.e., functionalized), and chemically linked to a polymeric substrate. As further described herein, conductors having nanometer dimensions are preferred. Conductors having such dimensions are generally referred to herein as nanoconductors and include nanowires, nanotubes, nanorods, nanobelts, nanoribbons, and nanoparticles. These conductors can be applied onto the polymeric substrates by spin coating, spraying, dip coating, screen printing, and inkjet printing.

The processes disclosed herein focus on the preparation of transparent conductors for application to substrates, and in particular for application to polymeric substrates. As will be discussed, at least one of the disadvantages of the prior art is addressed. Specifically, when thin films of transparent conductors are disbursed on polymeric substrates, they are prone to developing cracks due to stresses and strains to which the conductors are exposed. It is possible in certain applications to have the entire layer of the thin film peel away from the substrate.

In one embodiment described herein, a good durability of the transparent conductors is accomplished due to a strong covalent bond that exists between the transparent conductor and a dispersant that links the conductor to the polymeric substrate. This chemical bonding effectively integrates the transparent conductor material and the polymeric substrate together and ensures good stability of the transparent conductor system, even though the two components (transparent conductors and polymeric substrates) have very different mechanical, physical, and chemical properties.

An additional advantage in the described embodiments is found in a reduced manufacturing cost associated with the transparent conductors. More specifically, the transparent conductors described in this disclosure may be prepared using simple chemical procedures and without the use of high vacuum equipments and processes. The transparent conductors may also include inexpensive materials such as graphite. Incorporation of such materials is vastly different from current thin film deposition technologies and contributes to the cost savings mentioned herein.

Figure 6:
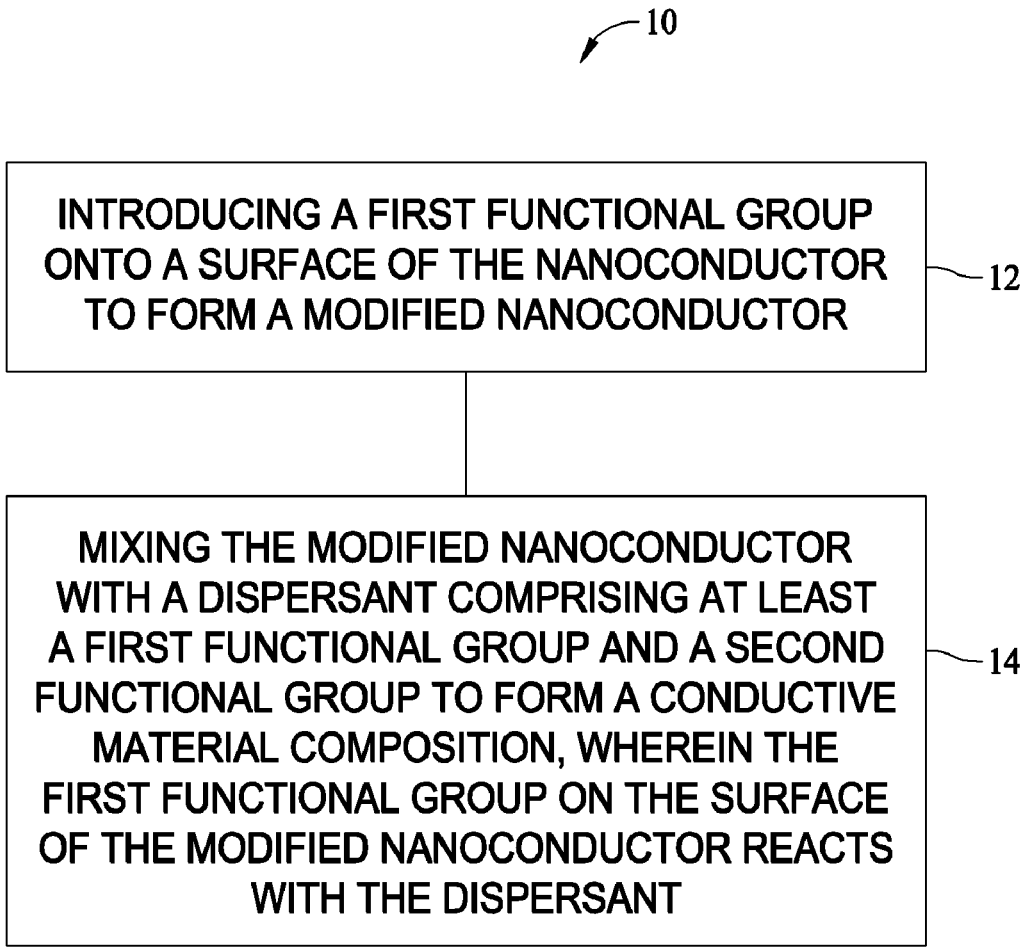
FIG. 6 is a flowchart illustrating a method of preparing a transparent nanoconductor for application to a polymeric substrate.

In one particular embodiment, the present disclosure is directed to a method of preparing a transparent nanoconductor for application to a polymeric substrate. FIG. 6 is a flowchart 10 illustrating this process. Specifically, the conductors are prepared by first introducing 12 a functional group onto a surface of the nanoconductor to form a modified nanoconductor. The modified nanoconductor is then mixed 14 with a dispersant, preferably at elevated temperatures, to form a conductive material composition. The dispersant is at least bifunctional, and comprises at least a first functional group and a second functional group. Upon mixing, the functional group on the surface of the modified nanoconductor reacts with the dispersant, and in particular, with one of the functional groups on the dispersant. The resulting mixture is a conductive material composition, which may be a resin, paste or ink.

The conductive material composition may then be applied to the polymeric substrate. The remaining unreacted functional group on the dispersant chemically reacts with the polymeric substrate to form a covalent bond. This chemical bonding effectively integrates the conductors and the polymeric substrate, ensuring good stability.

In another embodiment, the present disclosure is directed to a conductive material composition. The conductive material composition may be applied to the polymeric substrate to form an integrated product. The conductive material composition comprises a conductor, a dispersant, and optionally a solvent.

The conductors generally include one or more different material types such transparent conductive oxides, carbon conductors, metals, and combinations thereof. The transparent conductive oxides (TCOs) include, for example, indium tin oxide (ITO), doped zinc oxide (ZnO), cadmium oxide (CdO), antimony doped tin oxide (Sb—$SnO_2$), and combinations thereof Examples of carbon conductors include one or more of graphene sheets and carbon nanotubes. The metal conductors include silver, copper, nickel, gold, and combinations thereof. The conductivity of the TCOs and the carbon conductors is typically on the order of about $10^{-4}$ ohms-centimeter. Silver, copper, and gold are typically the best metal conductors and can conduct in the range of about 100-1000 times better than the TCOs and carbon conductors.

The above described conductors may be used alone or in combination with other conductors in the compositions and methods of the present disclosure. A hybrid (i.e., a combination of two or more) of the conductive materials introduced above may offer improved properties in conductivity and transparency as compared to a conductor that incorporates only a single one of the above listed conductive materials. All of the conductive materials can be used at nanometer scales. Conductors having such dimensions are generally referred to herein as nanoconductors and include, but are not limited to, nanowires, nanotubes, nanorods, nanobelts, nanoribbons, and nanoparticles. As used herein, the term "conductors" is thus intended to include nanoconductors.

As noted above, the conductors are modified to introduce a functional group onto a surface of the conductor. Suitable functional groups include, but are not limited to, hydroxyl (OH), amine ($NH_2$), mercapto (SH), carboxyl (COOH), sulfonyl chloride ($SO_2Cl$), vinyl (—C═C), acrylate (C═C—C═O), epoxy groups, ester, and combinations thereof. Any suitable method may be used to introduce the functional group onto the surface of the conductor. The method used to introduce the functional group may vary depending on the type of conductor.

For example, in one particular embodiment, the conductor is a transparent conductive oxide (TCO) and the functional group is a hydroxyl group. The hydroxyl group may be introduced onto the surface of the TCO conductor by subjecting the surface of the conductor to a cleaning process, such as is illustrated in FIG. 1.

Figure 1:
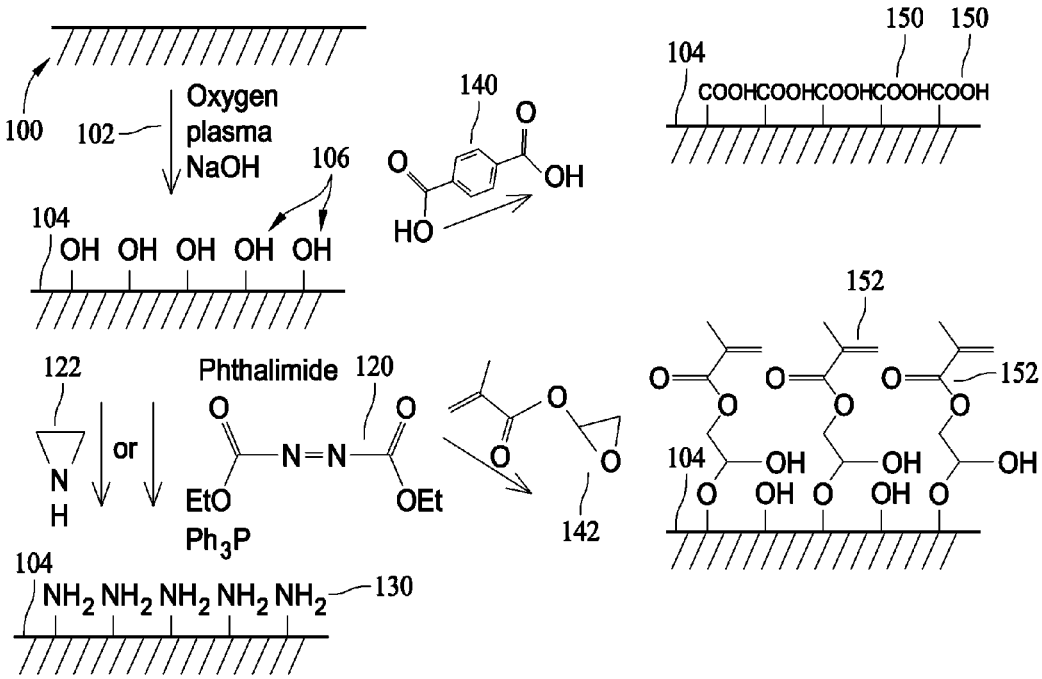
FIG. 1 illustrates surface modifications on transparent conductive oxide (TCO) conductors and conversion of hydroxyl functional group into different functional groups.

Specifically, as can be seen in FIG. 1, a nanowire conductor 100 comprising a conductor material such as indium tin oxide (ITO), is cleaned by sequential ultrasonic cleaning in deionized water, methanol, isopropyl alcohol, and acetone. In one particular embodiment, each step of the sequential ultrasonic cleaning is performed for about ten minutes. After the ultrasonic cleansing, the conductor is dried in air, and then exposed to oxygen plasma 102 for about five minutes at room temperature. In a specific embodiment, the oxygen plasma exposure is conducted at an oxygen pressure of about 200 mtorr and a plasma power of about 30 W. The conductors 100 are then immersed in a 0.05M sodium hydroxide (NaOH) solution for about five minutes and washed thoroughly with copious amounts of deionized water and dried in air. At the completion of this processing, the surface 104 of the ITO nanowire 100 should contain hydroxyl groups 106.

Figure 5:
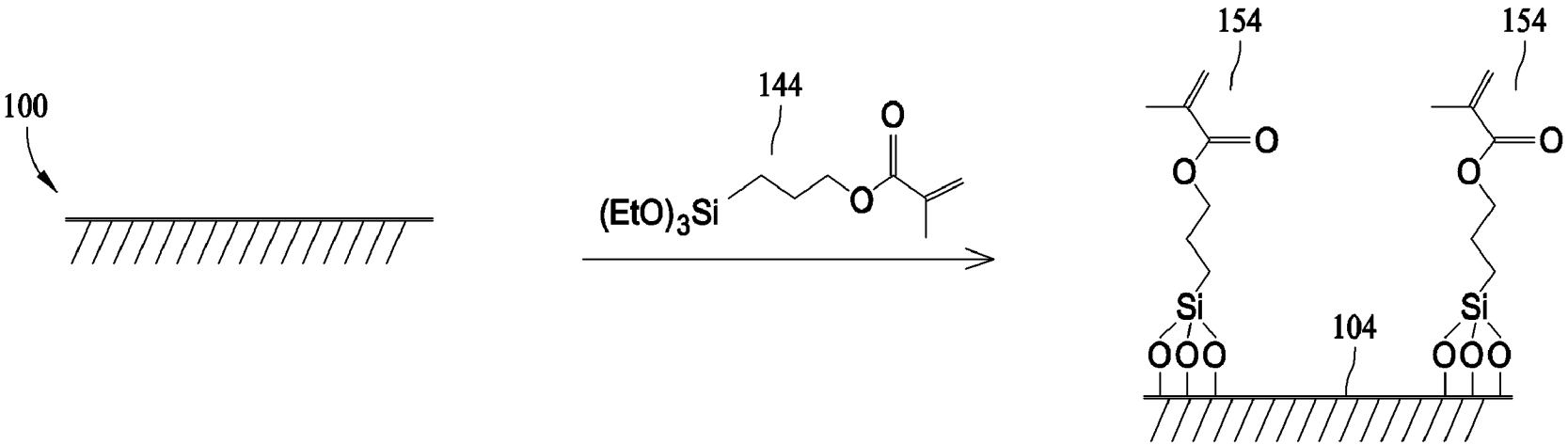
FIG. 5 illustrates surface modifications on a transparent conductive oxide (TCO) conductor by introducing an acrylate onto the surface of the conductor.

In another embodiment, the conductor 100 is a transparent conductive oxide and the functional group is an acrylate 154. In this embodiment, as shown in FIG. 5, the acrylate functional group 154 can be introduced onto the surface 104 of the conductor by exposing the conductor 100 to an acrylate reagent 144 at a temperature of about 80° C. overnight. Other functional groups may also be introduced onto the surface of the conductor using similar techniques.

Once the surface of the TCO conductor has been modified by introducing a first functional group onto the surface, the modified surface may optionally be further modified by converting the functional group to one or more different functional groups. Examples of such additional functional groups include, but are not limited to, an acrylate, an epoxy group, an ester, an amine, a mercapto group, sulfonyl chloride, vinyl, and a carboxyl group. Any suitable method may be used to convert the first functional group into one or more additional functional groups. This may be done, for example, by reacting the first functional group on the surface of the conductor with one or more reactant.

Some specific examples of such reactions are illustrated in FIG. 1. Specifically, as can be seen from FIG. 1, if the first functional group is a hydroxyl group 106, the conductor 100 comprising the hydroxyl groups 106 on the surface 104 thereof may be combined with a reactant such as phthalamide 120 or aziridine 122, or other amides or polyimides (not shown). The resulting reaction converts the hydroxyl groups 106 on the surface 104 of the conductor 100 into amine ($NH_2$) groups 130. Alternately, the hydroxyl groups 106 on the surface 104 of the conductor 100 can be reacted with a reactant such as an ester 140, or an amide, polycarbonate, or polyimide (not shown), at slightly elevated temperatures, which converts the hydroxyl groups 106 into carboxyl groups 150. In another alternative, the hydroxyl groups 106 on the surface 104 of the conductor 100 can be reacted with a reactant such as an epoxide 142 at slightly elevated temperatures, which converts the hydroxyl groups 106 into acrylate groups 152. Other suitable reactants may also be used. These reactions are general chemical transformations and can readily be achieved by one skilled in the art. The reactions provide a convenient method for modifying the surface 104 of TCO conductors 100 into desired functional groups.

Figure 2:
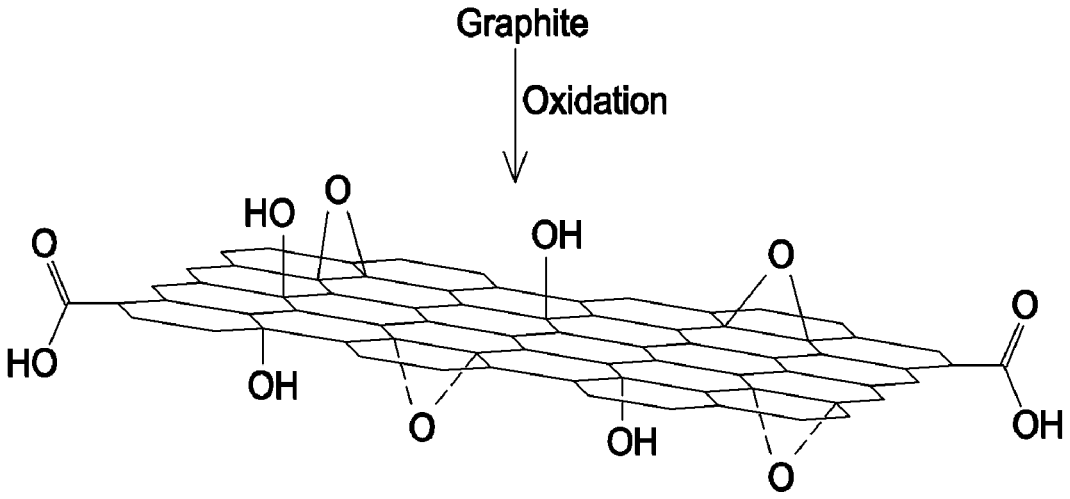
FIG. 2 illustrates surface modifications on carbon conductors.

In another embodiment, the conductor may be a carbon conductor, such as graphene. Functional groups may be introduced onto such a conductor by oxidizing graphite using potassium permanganate ($KMnO_4$) and sulfuric acid ($H_2SO_4$). This oxidation followed by a cleaning process generates hydroxyl groups, epoxide, and carboxyl functional groups on the surface of the graphene. This is illustrated in FIG. 2.

Once the surface of the carbon conductor has been modified by introducing a first functional group onto the surface, the modified surface may optionally be further modified by converting the functional group to one or more different functional groups. Examples of such additional functional groups include, but are not limited to, an acrylate, an epoxy group, an ester, an amine, a mercapto group, sulfonyl chloride, vinyl, and a carboxyl group. Any suitable method may be used to convert the first functional group into one or more additional functional groups. This may be done, for example, by reacting the first functional group on the surface of the conductor with one or more reactant, as described above for TCO conductors.

Once the surface of the conductor has been modified by introducing a functional group thereon, the modified conductor is mixed with a dispersant, and optionally a solvent, to form a conductive material composition. Typically, the conductive material composition will comprise the conductor in an amount of from about 0.5% (by weight of the composition) to about 90% (by weight of the composition), and dispersants in an amount of from about 10% (by weight of the composition) to about 90% (by weight of the composition). The exact amounts of conductor and dispersant present in the conductive material composition will vary depending on the specific application or requirements of conductivity and transmittance of the product produced.

The dispersants used in the compositions and methods of the present disclosure help with dispersing the conductors throughout the conductive material composition. Additionally, as noted above, the dispersants also act as a linker to chemically bond the conductors to the polymeric substrate, so that the conductors and polymeric substrate are fully integrated. This chemical bonding is achieved through functional groups present on the dispersant. Specifically, the dispersants are at least bifunctional, comprising at least a first functional group and a second functional group. When the dispersants are mixed with the modified conductors, e.g., at slightly elevated temperatures overnight, the functional group(s) on the surface of the conductor reacts with the dispersant, and in particular, with one of the functional groups on the dispersant. This reaction produces a stable, well dispersed conductive material composition, which may be a resin, paste or ink. Additional oligomerization on the modified conductors will improve the dispersity of the conductors in the dispersant. The conductive material composition may then be applied to a substrate, e.g., polycarbonates, polyacrylate, polyurethanes, polyimide (PI), polybenzimidazole (PBI), polybenzothiazole (PBT), polybenzoxazole (PBX), polysulfone, epoxy, or related systems. The remaining unreacted functional group on the dispersant chemically reacts with the polymeric substrate to form a covalent bond upon application of the composition to the substrate. This chemical bonding effectively integrates the conductors and the polymeric substrate, ensuring good stability. In certain instances, functional groups on the conductor may also bond directly onto the polymeric substrate, if the functional groups and polymeric substrate are compatible.

The dispersant may be any suitable substituted or unsubstitued aliphatic or aromatic compound that is at least bifunctional, i.e., comprises at least a first functional group and a second functional group. The first and second functional groups on the dispersant may be the same or alternately may be different functional groups. If the first and second functional groups on the dispersant are the same, preferably, one of the groups is protected during reaction with the conductor. This protection may then be removed prior to application of the conductive material composition to the polymer substrate.

Figure 3:
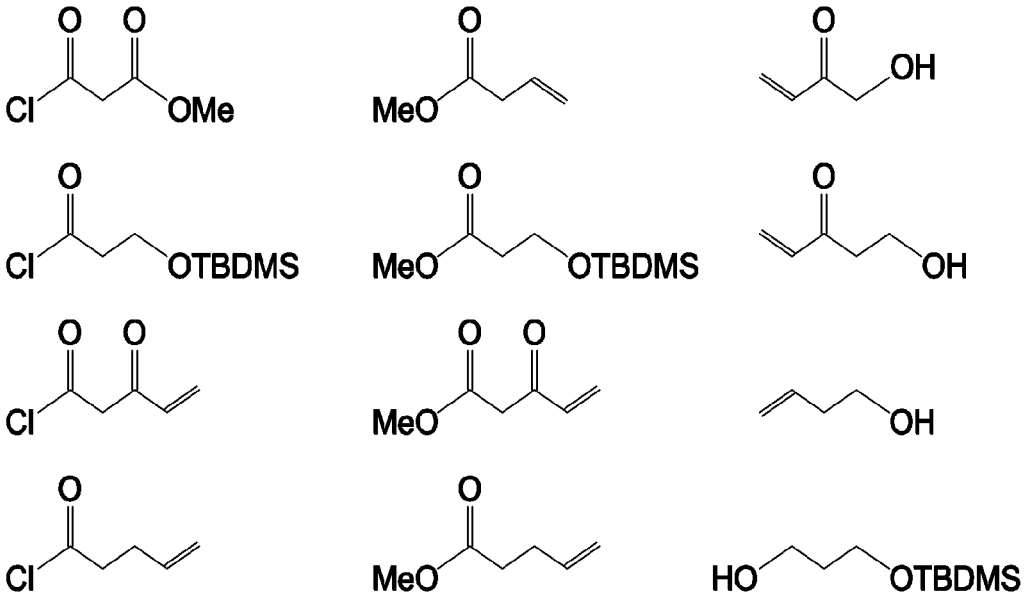
FIG. 3 illustrates some representative structures of the dispersants utilized in a transparent conductor fabrication process. TBDMS is an abbreviation of tert-butyl dimethylsilyl.
Figure 4:
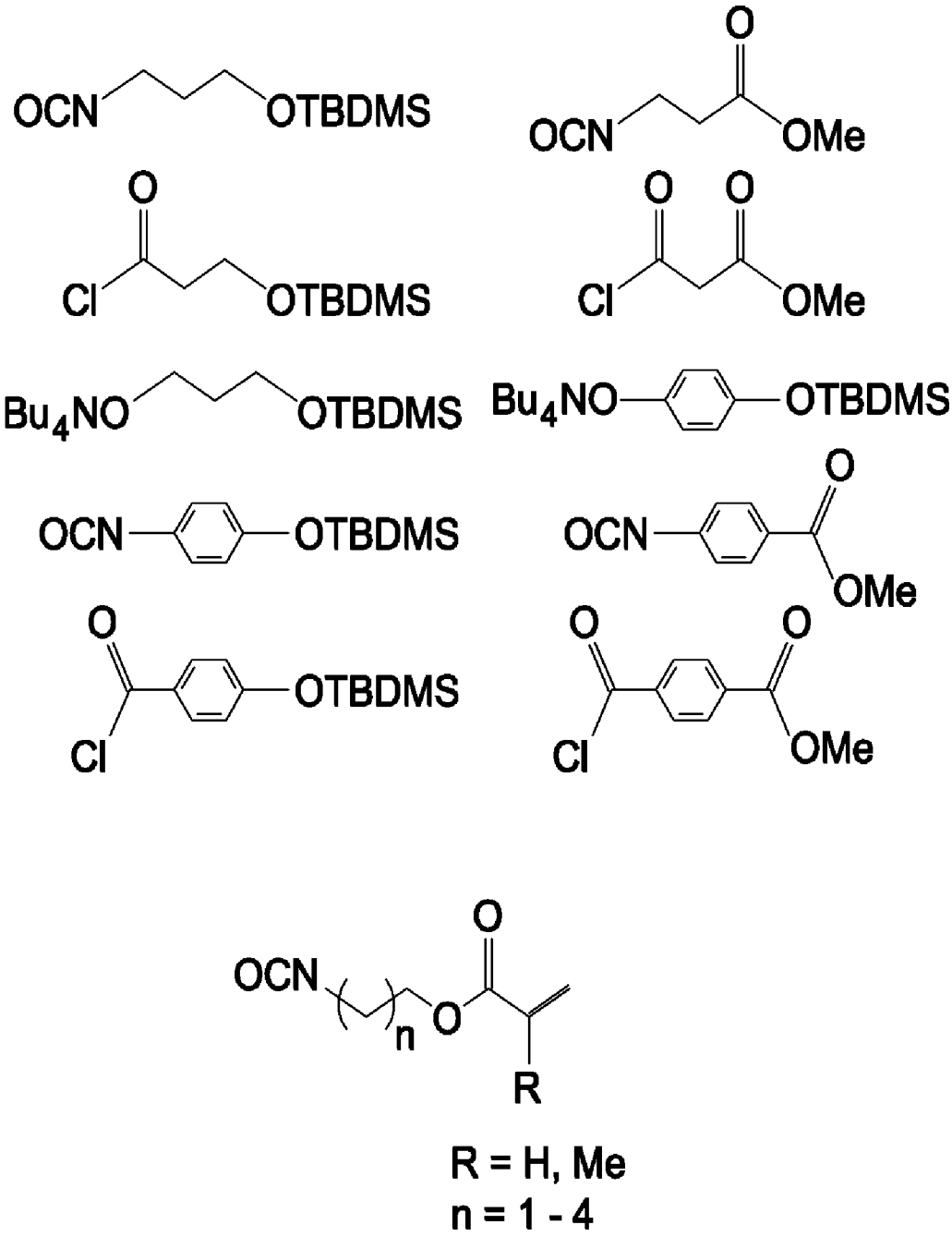
FIG. 4 illustrates some representative structures of the dispersants utilized in a transparent conductor fabrication process.

For example, in one embodiment, the dispersant has the structure:

$$R^2—R^1—R^3$$

Wherein $R^1$ is a substituted or unsubstitued aliphatic or aromatic hydrocarbyl moiety; and $R^2$ and $R^3$ are functional groups independently selected from the group consisting of acetyl chloride, carboxyl, ester, isocyanates, vinyl, acrylate, amine, aldehyde, and hydroxyl. Specific non-limiting examples of suitable dispersants are illustrated in FIGS. 3 and 4. It should be understood that the specific examples of dispersants illustrated herein are intended to be non-limiting, and thus may be modified without departing from the scope of the current disclosure.

As noted above, the conductive material composition may further optionally comprise a solvent. When present, the conductive material composition will comprise the solvent in an amount of from about 0.1% (by weight of the composition) to about 95% (by weight of the composition). The specific amount of solvent used depends on the form of the composition (e.g., ink, paste, resin). A variety of solvents can be used including methanol, ethanol, isopropyl alcohol, N-dimethylformamide, 2-isopropoxyethanol, tetrahydrofuran, acetonitrile, acetone, ethyleneglycol, 2-methoxyethanol, toluene, xylene, benzene, triethylamine, and combinations thereof. The solvents are typically combined with the conductors and dispersants prior to reacting the conductor and dispersant at slightly elevated temperatures, to form the conductive material composition.

As noted above, the conductive material composition can be made in the form of resins, pastes, and inks. The compositions can be applied on the polymeric substrates by any suitable method such as spin coating, spraying, dip-coating, screen printing, and ink-jet printing.

Resulting from the above described processing methods is a conductive material composition for the preparation of transparent conductors on polymeric substrates. The conductive materials composition includes conductors, dispersants, and optionally solvents. With respect to conductors, the conductive materials composition generally includes transparent conductive oxide conductors, including, but not limited to, one or more of indium tin oxide (ITO), doped zinc oxide (ZnO), cadmium oxide (CdO), antimony doped tin oxide (Sb—SnO2); carbon conductors such as graphene sheets and carbon nanotubes; and metal conductors such as silver, copper, nickel, and gold. The conductors can be nanoconductors, and can be nanotubes, nanowires, nanorods, nanobelts, nanoribbons, nanoparticles, or other forms that have a nanoscale dimension.

The above described embodiments are descriptive of a next generation of transparent conductors. The materials and processes described herein can be quickly incorporated into various production lines and manufacturing processes while also making the resulting systems that incorporate the described embodiments more robust and durable.

The described materials and processes utilize the transparent conductors in nanoscale dimension. As a result, internal stresses are not developed and cracks generally are not initiated within the conductor compositions. As described, the process modifies the surface of nano-conductors (e.g., transparent conductors) and incorporates the conductors into a polymer matrix by covalent bonding. By using such a process, the conductors are fully integrated into a matrix structure. Through various combinations of the processes and methods described herein, the resulting conducting layer is rendered a very durable and robust system.

While the invention has been described in terms of various specific embodiments, those skilled in the art will recognize that the invention can be practiced with modification within the spirit and scope of the claims.

What is claimed is:

1. A conductive materials composition comprising:

a nanoconductor selected from the group consisting of transparent conductive oxides, metals, graphene and combinations thereof, wherein a surface of the nanoconductor comprises a first functional group selected from the group consisting of a hydroxyl, an acrylate, an epoxy group, an ester, an amine, a mercapto, sulfonyl chloride, vinyl, and a carboxyl group;

a dispersant comprising at least a first functional group and a second functional group; and a solvent selected from the group consisting of isopropyl alcohol, 2-isopropoxyethanol, tetrahydrofuran, acetonitrile, 2-methoxyethanol, triethylamine, and combinations thereof;

the dispersant having a structure of: $R^2$—$R^1$—$R^3$;

wherein $R^1$ is a substituted or unsubstitued aliphatic or aromatic hydrocarbyl moiety; and $R^2$ and $R^3$ are functional groups independently selected from the group consisting of acetyl chloride, carboxyl, ester, isocyanates, vinyl, acrylate, amine, aldehyde, and hydroxyl.

2. The conductive materials composition of claim 1 wherein the transparent conductive oxide is selected from the group consisting of indium tin oxide, doped zinc oxide, cadmium oxide, antimony doped tin oxide, and combinations thereof.

3. The conductive materials composition of claim 1 wherein the metal is selected from the group consisting of silver, copper, nickel, gold, and combinations thereof.

4. The conductive materials composition of claim 1 wherein the composition comprises the nanoconductor in an amount of from about 0.5% (by weight composition) to about 90% (by weight composition).

5. The conductive materials composition of claim 1 wherein the composition comprises an additional solvent selected from the group consisting of methanol, ethanol, N-dimethylformamide, ethylene glycol, toluene, xylene, benzene, and combinations thereof.

6. The conductive materials composition of claim 1 wherein the composition comprises the solvent in an amount of from about 0.1% (by weight composition) to about 95% (by weight composition).

7. The conductive materials composition of claim 1 wherein the composition comprises the dispersant in an amount of from about 10% (by weight composition) to about 90% (by weight composition).

8. The conductive materials composition of claim 1 wherein the composition is a resin, a paste, or an ink.

9. A method of preparing a transparent nanoconductor for application to a polymeric substrate, the method comprising:

introducing a first functional group onto a surface of the nanoconductor to form a modified nanoconductor wherein the nanoconductor is selected from the group consisting of transparent conductive oxides, metals, graphene and combinations thereof and the first functional group is selected from the group consisting of a hydroxyl, an acrylate, an epoxy group, an ester, an amine, a mercapto, sulfonyl chloride, vinyl, and a carboxyl group; and mixing the modified nanoconductor a solvent and with a dispersant comprising at least a first functional group and a second functional group to form a conductive material composition, wherein the first functional group on the surface of the modified nanoconductor reacts with the dispersant wherein the solvent is selected from the group consisting of isopropyl alcohol, 2-isopropoxyethanol, tetrahydrofuran, acetonitrile, 2-methoxyethanol, triethylamine and combinations thereof;

the dispersant having a structure of: $R^2$—$R^1$—$R^3$;

wherein $R^1$ is a substituted or unsubstituted aliphatic or aromatic hydrocarbyl moiety; and $R^2$ and $R^3$ are functional groups independently selected from the group consisting of acetyl chloride, carboxyl, ester, isocyanates, vinyl, acrylate, amine, aldehyde, and hydroxyl.

10. The method of claim 9 further comprising applying the conductive material composition to the polymeric substrate.

11. The method of claim 10 wherein the conductive material composition is applied to the polymeric substrate by spin coating, spraying, dip-coating, screen printing, or ink-jet printing.

12. The method of claim 9 wherein the first functional group on the surface of the modified nanoconductor is a hydroxyl group.

13. The method of claim 12 further comprising converting the hydroxyl group on the surface of the modified nanoconductor to a second functional group selected from the group consisting of an acrylate, an epoxy group, an ester, an amine, a mercapto group, sulfonyl chloride, vinyl, a carboxyl group, and combinations thereof.

* * * * *